United States Patent [19]

Oliver

[11] Patent Number: 4,584,725

[45] Date of Patent: Apr. 29, 1986

[54] RETRACTABLE SQUAT-FACILITATION TOILET FOOTREST

[76] Inventor: Debra Oliver, P.O. Box 1791, Sedona, Ariz. 86336

[21] Appl. No.: 754,658

[22] Filed: Jul. 15, 1985

[51] Int. Cl.[4] ..... E03D 11/00

[52] U.S. Cl. ..... 4/254; 4/574; 4/661

[58] Field of Search ..... 4/254, 252 R, 661, 574; 297/429–431

[56] References Cited

U.S. PATENT DOCUMENTS

| | | | |
|---|---|---|---|
| 1,674,116 | 6/1928 | Lord | 4/254 |
| 2,023,901 | 12/1935 | Rhodes | 4/254 |
| 2,250,060 | 7/1941 | Finlay | 4/254 |
| 2,629,882 | 3/1953 | Blumenshine | 4/254 |
| 2,851,697 | 9/1958 | Dubay et al. | 4/254 |
| 4,012,797 | 3/1977 | Kristoffersen | 4/254 |

FOREIGN PATENT DOCUMENTS

| | | | |
|---|---|---|---|
| 508641 | 7/1939 | United Kingdom | 4/254 |

*Primary Examiner*—Henry K. Artis

*Attorney, Agent, or Firm*—Robert A. Hirschfeld; James F. Duffy

[57] ABSTRACT

Housing-retractable footrests are disposed on both sides of a conventional toilet, in a spatial relationship to the plane defined by the toilet seat which inclines the femurs of the toilet user into a healthful squatting position when the user's feet are emplaced upon the extended footrests. When not in use, the footrests are retractable into respective housings by a mechanical linkage manually operated by the user, or in another embodiment, power actuated. Footrest height adjustment is disclosed for adjusting the squatting-position geometry to persons of various leg lengths.

17 Claims, 6 Drawing Figures

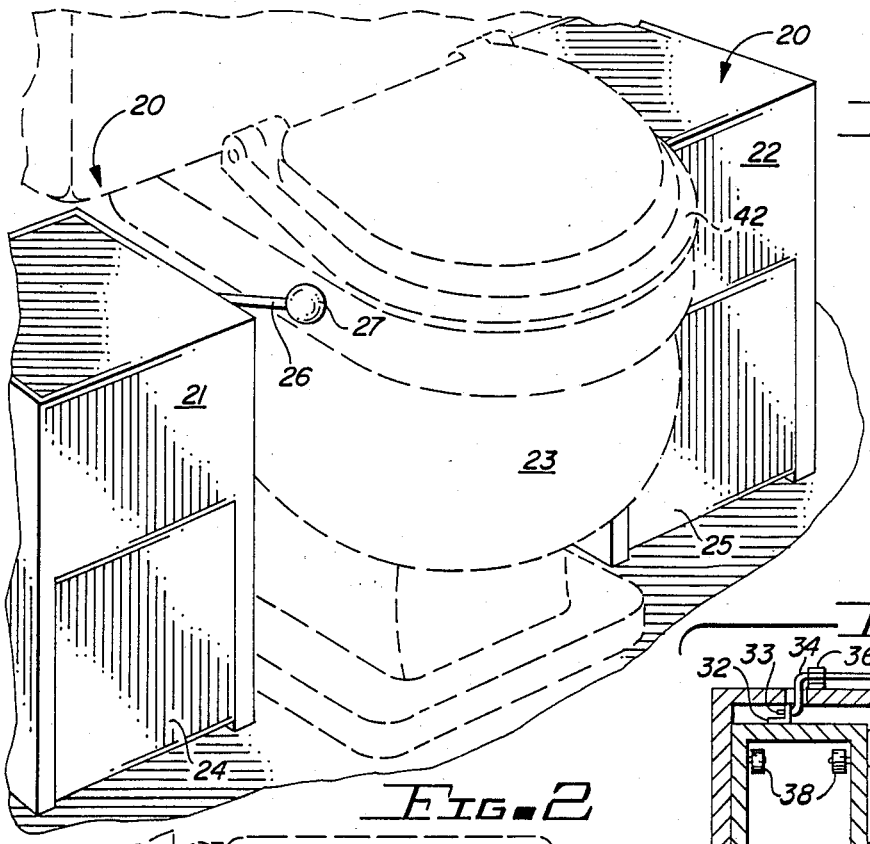
FIG. 1
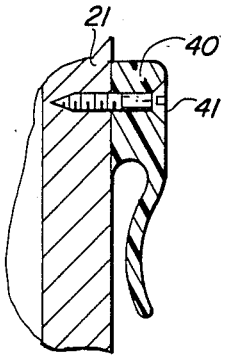
FIG. 6
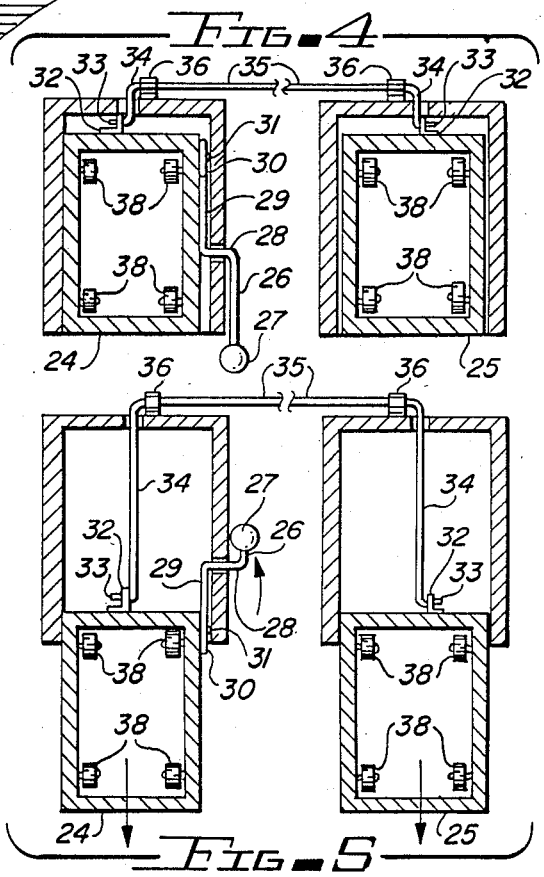
FIG. 4
FIG. 5
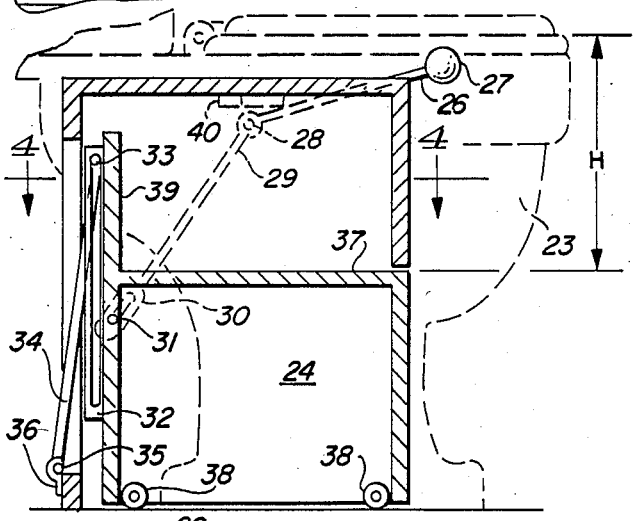
FIG. 2
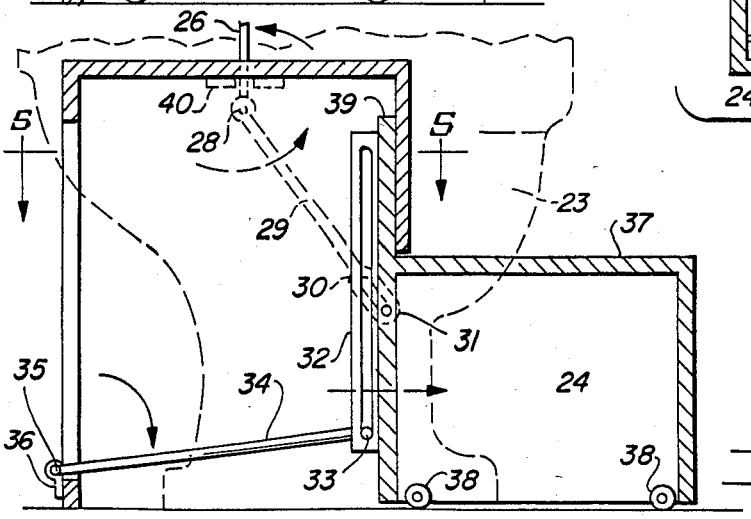
FIG. 3

RETRACTABLE SQUAT-FACILITATION TOILET FOOTREST

TECHNICAL FIELD

The invention relates generally to toilets and more particularly to retractable footrests for facilitating the seating of a toilet user in a squatting position.

RELATED APPLICATIONS

The inventor has concurrently submitted two other applications for letters patent, a "Squat-Facilitation Toilet Footrest" the structure of which is affixed to the toilet and is not retractable, and a "Squat-Facilitation Toilet Rocker", the structure of which provides for a rocking action by the toilet user, and is also not retractable. While each of said related applications provide for the facilitation of a squatting position by the toilet user, they are distinct, separate inventions compared to the invention herein disclosed.

BACKGROUND ART

The user of a conventional toilet is generally seated in a chair-like position, with the femur portion of each leg extending approximately horizontally, and the lower portion of the person's leg downward therefrom. Such conventional toilet position is unnatural, in comparison with the squatting position used by primates in the wild, by persons in primitive societies, and in other situations where seat-type toilets are unavailable. In the natural, squatting position, the femurs are extended or canted upward, with a resulting body position which properly aligns intestines, allows right use of gravity and abdominal tension, while relieving strain on sphincter muscles. Precipitation or aggravation of diseases of the urinary, lower digestive and intestinal tracts may be attributed to the unnatural position during waste elimination caused by use of conventional toilets.

The seat of a conventional toilet is generally too small for resting of the feet simultaneously with the buttocks; furthermore, the emplacement of the feet in the same plane as the buttocks may not only be uncomfortable, but may, through excessive extension or canting of the femur, cause muscle strain and elimination difficulties different from, but as undesirable as, the strain and elimination difficulties of the horizontal-femur conventional seating position of a conventional toilet. An ideal position for squatting-type toilet use is with the feet somewhat beneath the plane defined by the toilet seat, but elevated from conventional pendent or conventional-height floor position so that a substantial and healthful elevation or canting of the femur is achieved.

While persons who recognize the advantage of the squatting position in toilet use are free to place loose items or objects temporarily beneath their feet when using a conventional toilet, such objects may not be readily available, may not be of suitable height, and being loose may slip away during use. Further, it may cause undue bodily contortion and possible muscle strain to reach for such a loose footrest object and to emplace it after one is already seated upon the conventional toilet. While a footrest accessory nearby the toilet may be desirable, the accessory may get in the way of initial seating or arising from the conventional toilet.

Therefore, it is an object of the invention to provide a retractable squat-facilitation toilet footrest which, in retracted position is out of the way of a person initially being seated upon or arising from the toilet, and which, in extended, non-retracted or operative position provides a footrest suitable for elevating the femur of a person seated upon the toilet to a healthful squatting position by emplacement of a foot or the feet thereon.

A further object of the invention is to provide a retractable squat-facilitation toilet footrest which may be used in cooperation with a conventional toilet without being affixed to said toilet.

Another object of the invention is to provide a retractable squat-facilitation toilet footrest capable of supporting the weight of a toilet user when said user transfers the entire body weight in squatting position to the feet, as when the buttocks are not resting upon the toilet seat.

Yet another object of the invention is to provide convenient, manually operated means for extending the footrest from retracted to operative position, and for retracting the footrest from operative to retracted position.

A still further object of the invention is to provide a retractable squat-facilitation toilet footrest having mechanically coupled means for simultaneously extending and retracting left and right footrests.

Still another object of the invention is to provide a retractable squat-facilitation toilet footrest having power-assisted means for extending and retracting each footrest.

Another object of the invention is to provide a retractable squat-facilitation toilet footrest having means for adjusting the height of each footrest to suit the user.

DISCLOSURE OF THE INVENTION

A housing is disposed adjacent the left side of a conventional toilet, and a like housing is disposed on the right side. From each said housing, a footrest is extendable, each said footrest having a surface for resting of the corresponding foot of a person seated upon the toilet. The footrest surface is at a distance or height below the plane defined by the toilet seat, said distance or height being less than the distance from the sole of said person's foot to said person's corresponding knee, such that when the user places the soles of the feet upon the footrest in extended position, the user's knee is above the plane defined by the toilet seat, and by geometric inference, the user's femurs are necessarily inclined or canted upwards in a squatting position.

The footrests are retractable into the respective housings at the user's option. Such retraction is convenient when the user initially is seated or arises from the toilet seat. In the preferred embodiment shown, each footrest rolls by means of rollers upon the floor, and is urged into retraction or extension by a mechanical linkage, manually operated via a handle by the toilet user. A mechanical linkage between the right and left footrests permits simultaneous urging of both footrests into retraction or extension. The handle operating the linkage is conveniently disposed within reach of a seated user, and is retained in extended position by a catch, to prevent inadvertent retraction while the user's weight impinges upon the footrests.

In another embodiment, the manually operated linkage is replaced by or assisted by a power apparatus such as an electric motor, hydraulic plunger or the like, as would be easily implemented by one skilled in the art.

In still another embodiment, the relative height of each footrest is adjustable manually or by power assisted means, to vary the relative height of each footrest in accordance with the varying leg lengths of different users. Such height adjustment is accomplished by jackstands, shims, hydraulic or pneumatic devices and the like as would be easily implemented by one skilled in the art.

When using the invention, the user may be first seated in ordinary position upon the toilet with the footrests retracted, then extend the footrests and place the feet upon the footrests, or may ascend the footrests in extended position initially and thereafter assume the squatting position. The user may distribute body weight partially through the buttocks onto the toilet seat with the remaining portion of body weight through the feet onto the footrests; alternatively, the user may by raising the buttocks above the toilet seat, place all body weight through the feet upon the footrests. The footrests are constructed with sufficient weight-bearing strength to support the full body weight of the user.

BRIEF DESCRIPTION OF THE DRAWINGS

FIG. 1 is a perspective view of the invention used in conjunction with a conventional toilet.

FIG. 2 is a cutaway side elevation of the invention of FIG. 1, seen from the user's right side, with the footrest shown in retracted position.

FIG. 3 is a view similar to that of FIG. 2, with the footrest shown in extended or operative position.

FIG. 4 is a top cutaway view along lines 4—4 of FIG. 2.

FIG. 5 is a top cutaway view along lines 5—5 of FIG. 3.

FIG. 6 is a top cutaway enlarged detailed view of FIGS. 2 and 3, showing the catch seen in phantom in FIGS. 2 and 3.

BEST MODE FOR CARRYING OUT THE INVENTION

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications of the illustrated device, and such further applications of the principles of the invention as illustrated therein being contemplated as would normally occur to one skilled in the art to which the invention relates.

The invention is generally referred to in FIG. 1 as number 20. Right footrest carrier 24 is shown retracted into right housing 21. Left footrest carrier 25 is shown retracted into left housing 22. Housings 21,22 are free-standing structures disposed at respective right and left sides of toilet body 23. Retraction and extension are manually urged by the user grasping handle 27 of control lever 26. Toilet body 23 and toilet seat 42 are shown in FIG. 1 in phantom.

In FIGS. 2,3, 4 and 5, side and top views of the invention are shown, retracted in FIGS. 2,4, and extended in FIGS. 3,5. In FIGS. 2,3, right footrest carrier 24 rolls upon rollers 38, upon a floor (not separately indicated). Right footrest 37 is in a plane a distance or height "H" below the plane defined by toilet seat 42, wherein "H" is less than the distance between the user's knee and the sole of the user's foot. Thus, it may be seen that, in extended condition of FIG. 3, placement of the user's right foot upon footrest 37 while said user's buttocks are upon the toilet seat, necessarily results in the upward inclining of the user's right femur with respect to the user's buttocks, producing a "squatting" body position. (A like description applies to the user's emplacement of the left foot upon the left footrest, not separately indicated.)

Control lever 26, grasped by handle 27, pivots upon pivot 28. In the retracted position shown in FIG. 2, lifting of handle 27 produces a downward-forward motion of control lever extension 29, coupled at pivot 28 to control lever 26. At the extremity of control lever extension 29, slide coupling 30 coacts with slide coupling pin 31 to urge right footrest carrier 24 outward towards extended or operative position shown in FIG. 3. A second slide coupling 32 is affixed to right footrest carrier 24. Said outward motion of footrest carrier 24 urges pin 33 at one end of transmission arm 34 downward, applying corresponding torque to transmission shaft 35, which pivots in clips 36, and extends transversely behind toilet body 23 to left housing 22. A corresponding transmission arm 34 within left housing 22 converts the torque in transmission shaft 35 into a corresponding force, through corresponding pin 33 and slide coupling 32 affixed to left footrest carrier 25, urging left footrest carrier 25 into following the motion of right footrest carrier 24. Extension limiter 39 prevents overextension of the footrest carriers 24,25 from their respective housings 21,22. The direction of forces and motions described above for extension are reversed when urging the footrest carriers 24,25 from the extended or operative position of FIGS. 3,5 back into the retracted position of FIGS. 2,4. Slides, pivots and the like may support carriers 24,25 during disposition instead of rollers 38.

FIG. 6 shows a clip 40 attached by screw 41 to the side of right housing 21 (seen in phantom in FIGS. 2,3. Clip 40 releasably captures control lever 26 in extended position shown in FIG.2, preventing inadvertent retraction until manual release of control lever 26.

The mechanical linkage 27,26,28,29,35,34,33,32 is an example of one embodiment of a simultaneous retraction mechanism. Those skilled in the art will readily be able to implement alternative linkages and retraction mechanisms, including but not limited to electrical, hydraulic and other power actuated mechanisms, not shown here in detail, but within the contemplated scope of the invention. Further, it may be seen that the optimum distance or height "H" may vary from person to person, being less for a child or shorter person than for an adult or taller person. The embodiment illustrated in the figures is at a height "H" chosen as a compromise for a reasonable range of user leg length; however, it is within the contemplated scope of the invention, and within the ordinary realization ability of one skilled in the art, to provide footrest carriers of various heights, or of adjustable height by means of jackstands, hydraulic lift mechanisms and the like. Shims of varying thicknesses may also within said scope be utilized by those skilled in the art to achieve adjustable values of "N" according to the needs of individual toilet users. Said shims (not shown) would be applied to vary the relative vertical locus of casters or rollers 38, or of footrest surfaces 37 with respect to footrest carriers 24,25.

Those skilled in the art will conceive of other embodiments of the invention which may be drawn from the disclosure herein. To the extent that such other embodiments are so drawn, it is intended that they shall fall within the ambit of protection provided by the claims herein.

Having described my invention in such a clear and concise manner in the foregoing description and drawings that those skilled in the art may readily understand and practice the invention, that which I claim is:

1. A retractable squat-facilitation footrest for use by a person seated upon a toilet, said toilet having a seat, said seat defining a seat plane, said retractable squat-facilitation footrest comprising:

housing means adjacent said toilet;

first means retractingly coupled to said housing means for upwardly inclining when said first means is in an extended state the femur of a person seated upon said toilet, and second means coupled to said housing means for retracting said first means into said housing means and for extending said first means from said housing.

2. The retractable squat-facilitation footrest of claim 1 wherein said first means for upwardly inclining the femur of a person seated upon said toilet comprises footrest means, said footrest means defining in said extended state a footrest plane in substantially parallel spaced relationship to said seat plane, the height above said footrest plane of said seat plane substantially less than the distance from a knee of said person to said footrest plane when the soles of the feet of said person rest upon said footrest means.

3. The retractable squat-facilitation footrest of claim 2 wherein said housing means comprises right housing means and left housing means, said footrest means comprises a right footrest coplanar said footrest plane, a right footrest carrier retractable into said right housing means, a left footrest coplanar said footrest plane, and a left footrest carrier retractable into said left housing means, said right footrest coupled to said riqht footrest carrier for establishing the locus of said right footrest with respect to said seat, said left footrest coupled to said left footrest carrier for establishing the locus of said left footrest with respect to said seat.

4. The retractable squat-facilitation footrest of claim 3 further comprising right roller means coupled to said right footrest carrier for rolling disposition of said right footrest carrier upon a floor, and left roller means coupled to said left footrest carrier for rolling disposition of said left footrest carrier upon said floor.

5. The retractable squat-facilitation footrest of claim 3 wherein said second means for retracting said first means into said housing means and for extending said first means from said housing means comprises control lever means pivotingly coupled to said right housing means and to said right footrest carrier, and transmission means coupled between said right footrest carrier and said left footrest carrier for transmitting force applied by said control lever upon said right footrest carrier into corresponding force upon said left footrest carrier.

6. The retractable squat-facilitation footrest of claim 3 wherein said second means for retracting said first means into said housing means and for extending said first means from said housing means comprises control lever means pivotingly coupled to said left housing means and to said left footrest carrier, and transmission means coupled between said right footrest carrier and said left footrest carrier for transmitting force applied by said control lever upon said left footrest carrier into corresponding force upon said right footrest carrier.

7. The retractable squat-facilitation footrest of claim 3 further comprising means for simultaneously imparting motion to said right and left footrest carriers.

8. The retractable squat-facilitation footrest of claim 1 wherein said second means comprises power-assisted means for retracting said first means into said housing and for extending said first means from said housing.

9. The retractable squat-facilitation footrest of claim 1 further comprising means for adjusting the height of said first means to suit the user.

10. The retractable squat-facilitation footrest of claim 3 further comprising means for supporting said right footrest carrier and said left footrest carrier upon a floor while disposing said footrest carriers upon said floor.

11. A retractable squat-facilitation footrest for use by a person seated upon a toilet, said toilet having a seat, said seat defining a seat plane, said retractable squat-facilitation footrest comprising:

housing means adjacent said toilet;

footrest means defining in an extended state a footrest plane in parallel spaced relationship to said seat plane, the height above said footrest plane of said seat plane substantially less than the distance from a knee of said person to said footrest plane when the soles of the feet of said person rest upon said footrest means, for upwardly inclining when said first means is in said extended state the femur of said person seated upon said toilet; and means coupled to said housing means for retracting said footrest means into said housing means and for extending said footrest means from said housing.

12. The retractable squat-facilitation footrest of claim 11 wherein said housing means comprises right housing means and left housing means, said footrest means comprises a right footrest coplanar said footrest plane, a right footrest carrier retractable into said right housing means, a left footrest coplanar said footrest plane, and a left footrest carrier retractable into said left housing means, said right footrest coupled to said right footrest carrier for establishing the locus of said right footrest with respect to said seat, said left footrest coupled to said left footrest carrier for establishing the locus of said left footrest with respect to said seat.

13. The retractable squat-facilitation footrest of claim 12 further comprising right roller means coupled to said right footrest carrier for rolling disposition of said right carrier footrest upon a floor, and left roller means coupled to said left footrest carrier for rolling disposition of said left footrest carrier upon said floor.

14. The retractable squat-facilitation footrest of claim 12 further comprising means for simultaneously imparting motion to said right and left footrest carriers.

15. The retractable squat-facilitation footrest of claim 11 wherein said means for retracting said footrest means into said housing means and for extending said footrest means from said housing comprises power-assisted means.

16. The retractable squat-facilitation footrest of claim 11 further comprising means for adjusting the height of said footrest means to suit the user.

17. The retractable squat-facilitation footrest of claim 12 further comprising means for supporting said right footrest carrier and said left footrest carrier upon a floor while disposing said footrest carriers upon said floor.

* * * * *